US006705847B1

(12) United States Patent
Sagawe et al.

(10) Patent No.: US 6,705,847 B1
(45) Date of Patent: Mar. 16, 2004

(54) ROTARY DISPLACEMENT MACHINE HAVING AT LEAST TWO ANNULAR DISPLACEMENT GEARS AND SUPPLY CHANNELS

(76) Inventors: Johann Sagawe, Grüner Winkel 12, 77876 Kappelrodeck (DE); Gottfried Sagawe, Unterer Bergauer Platz 12, 90402 Nürnberg (DE)

( * ) Notice: Subject to any disclaimer, the term of this patent is extended or adjusted under 35 U.S.C. 154(b) by 0 days.

(21) Appl. No.: 10/069,843

(22) PCT Filed: Aug. 28, 2000

(86) PCT No.: PCT/DE00/02927

§ 371 (c)(1),
(2), (4) Date: Jul. 9, 2002

(87) PCT Pub. No.: WO01/16489

PCT Pub. Date: Mar. 8, 2001

(30) Foreign Application Priority Data

Aug. 27, 1999 (DE) ..... 199 40 730

(51) Int. Cl.[7] ..... F01C 1/18

(52) U.S. Cl. ..... 418/15; 418/206.1; 418/206.4; 418/206.7

(58) Field of Search ..... 418/15, 206.1, 418/206.4, 206.7

(56) References Cited

U.S. PATENT DOCUMENTS 2,301,496 A * 11/1942 Aldrich ..... 417/310
2,944,487 A * 7/1960 Walsh ..... 418/15
3,133,506 A * 5/1964 Luciani ..... 418/206.7

FOREIGN PATENT DOCUMENTS

| | | | |
|---|---|---|---|
| DE | 190361 | * 10/1907 | |
| DE | 254645 | * 12/1912 | |
| DE | 328 963 | 6/1919 | |
| DE | 323327 | * 7/1920 | ..... 418/206 |
| DE | 462251 | * 7/1928 | ..... 418/206 |
| DE | 867652 | * 2/1953 | |
| DE | 195 33 215 | 3/1997 | |
| DE | 196 38 332 | 3/1998 | |
| FR | 948868 | * 2/1949 | |
| FR | 1405724 | * 5/1965 | |
| GB | 547463 | * 8/1942 | ..... 418/206 |
| GB | 1250927 | * 10/1971 | |
| GB | 2161861 | * 1/1986 | |

* cited by examiner

*Primary Examiner*—John J. Vrablik
(74) *Attorney, Agent, or Firm*—Gudrun E. Huckett

(57) ABSTRACT

A rotary displacement machine has a housing and at least two annular displacement gears arranged in the housing and supported rotatably on a stationary axle, receptively. The at least two annular displacement gears have external teeth for conveying a fluid. At least two supply channels are provided in the housing and have a supply mouth, respectively, opening toward the annular displacement gears for supplying a fluid to the annular displacement gears. The supply mouth is configured such that, upon operation of the rotary, displacement machine, a fluid exiting from the supply mouth reaches either only the teeth of a single one of the annular displacement gears or only the teeth of the annular displacement gears rotating in the same direction.

7 Claims, 4 Drawing Sheets

ROTARY DISPLACEMENT MACHINE HAVING AT LEAST TWO ANNULAR DISPLACEMENT GEARS AND SUPPLY CHANNELS

BACKGROUND OF THE INVENTION

1. Field of the Invention

The invention relates to a rotary displacement machine with at least two displacement gear wheels with external teeth for conveying a fluid and with at least two supply channel with supply mouths in the area of the displacement gear wheels for supplying the fluid to the displacement gear wheels, wherein each one of the supply mouths is configured such that upon proper operation of the rotary displacement machine fluid exiting from the supply mouth can reach either only the teeth of a single displacement gear wheel or only the teeth of such displacement gear wheels which rotate in the same direction. The invention furthermore relates to a housing for such a machine.

2. Description of the Related Art

Rotary displacement machines of the aforementioned kind can be used as pumps, i.e., as pressure generators, as well as motors, i.e. pressure consumers. When the rotary displacement machine is used as a motor, the conveyed fluid is generally a hydraulic oil. When the machine is used as a pump, different fluids can be conveyed, particularly, however, liquids such as oil, water and the like.

A rotary displacement machine with the aforementioned features is known from GB 2 161 861. A similar machine is also disclosed in FR 946 868.

In addition, from different documents, for example, DE 190 361 or DE 254 645, rotary displacement machines are known in which displacement gear wheels with external teeth or with means comparable to such displacement gear wheels (DE 190 361) are provided wherein, however, the supplied fluid does not reach either only the teeth of a single displacement gear wheel or only the teeth of such displacement gear wheels which rotate in the same direction.

Other rotary displacement machines are known, for example, from DE 195 33 215 A1 or DE 254 645 C1, in the form of gear pumps with two displacement gear wheels arranged in a housing, wherein one of the displacement gear wheels is driven by a drive gear wheel arranged in the housing.

From DE 196 38 332 A1 and DE 328 963 C1, gear pumps also having two displacement gear wheels arranged in a housing are known in which one of the displacement gear wheels is driven by a shaft extending from the housing.

Even though the known rotary displacement machines have been successfully used in practice for decades, at high rotary speeds problems result in regard to turbulences and cavitation which limit the efficiency and the applications of the machines and which have the effect that filling of the conveying chambers formed between the teeth of the displacement gear wheels is not optimal.

One basic problem are the displacement gear wheels provided in all of the aforementioned known rotary displacement machines because they must be supported in a complex way which also entails sealing problems.

SUMMARY OF THE INVENTION

Based on this, it is an object of the invention to provide a rotary displacement machine exhibiting easy running properties and being easily sealed and having a minimal weight. Moreover, turbulences in the supply area, i.e., in that area in which the medium to be conveyed is transferred from the supply channels into the conveying chambers, are to be substantially prevented and filling of the conveying chambers is to be improved.

The object is solved by a rotary displacement machine of the aforementioned kind in which the displacement gear wheels ere configured in the form of annular displacement gears rotatably supported about a stationary axle, respectively.

Instead of classical gear wheels, annular gears are used which are sometimes also referred to as gear rings, for conveying the fluid. In the following, these annular gears are therefore referred to as annular displacement gears.

By employing annular displacement gears sealing and bearing problems can be prevented and material can be saved so that also the weight can be reduced. Surprisingly, it was found that the rotary displacement machine embodied in this way also runs more quietly and more smoothly than the prior art rotary displacement machines of a comparable size. The annular gears can be supported in an especially simple way, and the shafts which are required for gear wheels are no longer necessary. Depending on the size and configuration of the annular gears, one bearing for each annular gear can be sufficient, while rotating shafts must be supported always on both ends.

In a rotary displacement machine embodied in this way, well-defined fluid flows result during operation while in the case of some of the rotary displacement machines known from the aforementioned prior art references, which have a right-handed displacement gear wheel and a left-handed displacement gear wheel, the fluid, after exiting the supply mouth, can be entrained by the right-handed as well as the left-handed displacement gear wheel so that disturbing vortices and cavitations are generated in the fluid flow. With the embodiment according to the invention, filling losses are reduced and the fluid can be supplied to the displacement gear wheels such that the impulse transmitted by the flowing fluid onto the displacement gear wheels does not unnecessarily brake the rotation of the displacement gear wheels.

Generally, a displacement machine embodied according to the present invention will have two meshing displacement gear wheels wherein each one of the displacement gear wheels has at least one supply mouth correlated therewith. However, it is also possible to provide, for example, four displacement gear wheels of which two are arranged on a common axis atop one another, respectively. In the case of such a machine, it can be sufficient to provide also only two supply mouths when these are configured such that the exiting fluid can reach only the displacement gear wheels arranged on the common axis.

A principal idea in regard to the rotary displacement machine is the corresponding guiding of the fluid flows whereby a significant improvement of the efficiency of the rotary displacement machine can be achieved.

In a constructively especially simple configuration of a rotary displacement machine, only one supply channel with a number of supply mouths is provided which number corresponds to the number of displacement gear wheels. Such a rotary displacement machine can be arranged in a housing of a simple configuration which must have only one inlet for introducing the fluid into the supply channel.

For certain applications it may however also be advantageous when several supply channels are provided; in particular, preferably as many as displacement gear wheels are provided. Each supply channel can then be provided with its own inlet so that such a machine, when it is used as a motor, can be operated with fluid coming simultaneously from different pressure sources and, when it is used as a pump, can suck in fluid from different reservoirs. The rotary displacement machine can then advantageously also be used as a mixer.

In a preferred embodiment, the displacement gear wheels are arranged in a housing in which the supply mouths and/or the supply channel/channels are formed by a corresponding shaping. It is then no longer necessary to provide special components and/or seals for forming the supply mouths and the supply channels.

In order to further improve the efficiency of a rotary displacement machine, in which two displacement gear wheels are arranged in a housing and mesh with one another in one area (meshing area), according to an advantageous embodiment of the invention at least one connecting channel is provided which connects directly or indirectly the meshing area with at least one conveying chamber formed between the teeth of a displacement gear wheel and the inner side of the housing.

Such a connecting channel enables the transfer of fluid from the meshing area into at least one conveying chamber formed between the teeth of a displacement gear wheel so that filling of the chamber is further increased. In the case of the previously known displacement pumps, connecting channels are partially also provided in the meshing area; however, they are connected with the respective reservoir from which fluid is taken so that in the previously known machines the pressure generated in the meshing area is used to convey the fluid to the area where it should actually be sucked away.

The connecting channel/channels can be connected by corresponding lines or directly with one or several conveying chambers. It is particularly advantageous to form the connecting channel/channels by a corresponding shaping of the housing, in particular, in that on the inner side of the housing surrounding the displacement gear wheels one or several grooves are provided.

The driving action (when the rotary displacement machine is used as a pump) or the output action (when the rotary displacement machine is used as a motor) can be realized advantageously in different ways adjusted optimally with regard to the respective application. Accordingly, it is possible to configure the machines such that at least one of the displacement gear wheels comprises a drive shaft or an output shaft which is then extended to the outer side of the corresponding housing surrounding the displacement gear wheels where, as is known in the art, it is driven or drives, but it is also possible to provide a drive gear wheel meshing with one of the displacement gear wheels (of course, the drive gear wheel, in the case of use of the rotary displacement machine as a motor, should be referred to as an output gear wheel but will be referred to always as a drive gear wheel in the following for reasons of clarity).

When such a drive gear wheel is provided, it has been found to be particularly advantageous to arrange it in an area between the displacement gear wheels that is not accessible to the fluid to be conveyed.

In a preferred configuration of a rotary displacement machine with such a drive gear wheel, the transmission ratio between the drive gear wheel and the driven (output) displacement gear wheel is greater than 1:3 and is particularly between 1:4.5 and 1:6.5. This not only reduces the torque to be provided in the case of application as a pump; it was also found that such a transmission ratio also contributes advantageously to a reduction of the operating noise.

BRIEF DESCRIPTION OF THE DRAWINGS

Further details and advantages of the invention result from the purely exemplary and non-limiting description of a few embodiments of the invention in connection with the drawing, in which.

DESCRIPTION OF PREFERRED EMBODIMENTS

Figure 1:
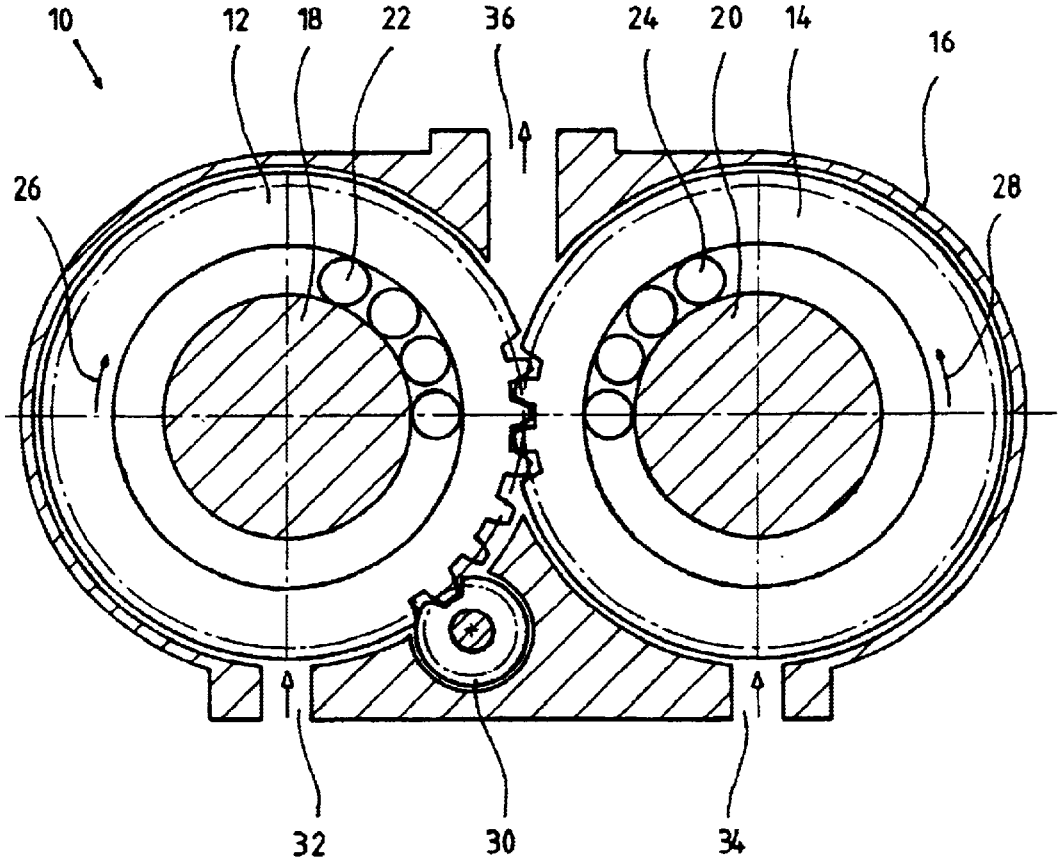
FIG. 1 shows a schematic cross-section of a rotary displacement machine according to the invention with two displacement gear wheels and a drive gear wheel.

In FIG. 1, a rotary displacement machine, identified in its entirety at 10, is shown in which two displacement gear wheels configured as annular displacement gears 12 and 14 are arranged in a housing 16 such that they mesh within one area.

The annular displacement gears are supported to be rotatable about a stationary axle 18 or 20, respectively. The supporting action between axle and annular gear is realized by balls 22 and 24, respectively, wherein, for reasons of clarity, only a few balls are illustrated of which only one is identified by reference numeral, respectively.

As indicated by the arrows 26 and 28, upon proper operation of the rotary displacement machine 10 the annular displacement gear 12 to the left in the Figure rotates right-handed while the annular displacement gear 14 to the right in the Figure rotates left-handed.

For providing a driving action or output action of the annular displacement gears, a drive gear wheel 30 is provided in this embodiment which meshes with the annular displacement gear 12 and has a diameter which is approximately six times smaller than that of the annular displacement gear 12.

The drive gear wheel 30 is arranged such in the housing 16 between the annular displacement gears 12 and 14 that it is encapsulated relative to the incoming fluid.

For supplying fluid, two separate supply channels 32 and 34 are provided in this embodiment wherein the supply channel 32 is correlated with the annular displacement gear 12 and the supply channel 34 is correlated with the annular displacement gear 14, each forming only one supply mouth. At the outer side of the housing 16 connectors for supplying fluid into the supply channels 32 and 34 are provided which are of a known design and therefore not illustrated. An outlet 36 is provided for removing the conveyed fluid.

During operation of the rotary displacement machine, the fluid to be conveyed flows via the supply mouths of tile supply channels 32 and 34 into the conveying chambers formed between the teeth of the annular displacement gears 12 and 14 and is then expelled via the outlet 36, in this embodiment after approximately three-fourths of a revolution of the respective annular displacement gear. Possibly unexpelled residual amounts of the conveyed fluid, which, depending on the configuration of the machine, can still be present between the teeth of the annular displacement gear 12 after passing the area in which the annular displacement gears mesh with one another, can reach the drive gear wheel 30 and advantageously contribute to lubrication of the meshing area of the annular displacement gear 12 and the drive gear wheel 30.

Figure 2:
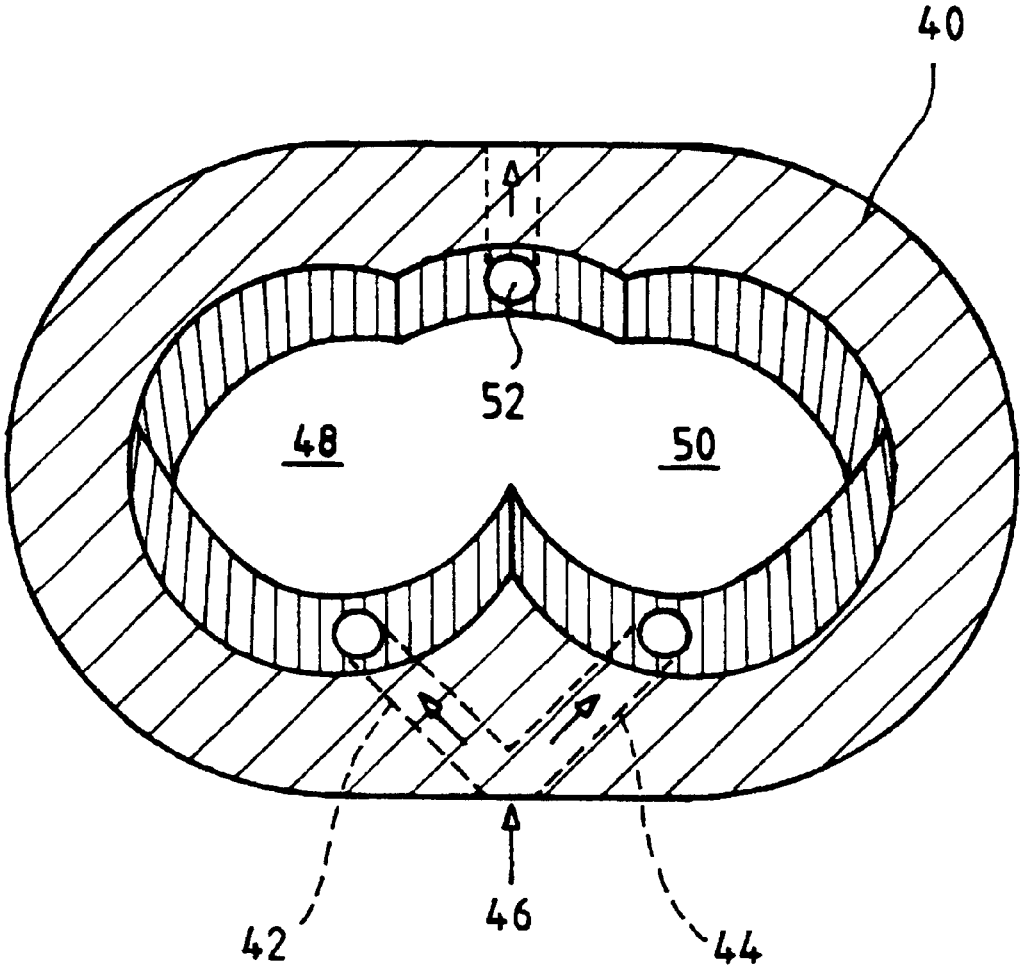
FIG. 2 shows a schematic illustration of a part of a housing according to the invention for a rotary displacement machine with two displacement gear wheels.

In FIG. 2, a section of the housing 40 for a rotary displacement machine is shown in which two supply channels for supplying fluid to be conveyed are formed, as illustrated by dashed lines 42 and 44.

The supply channels in this embodiment have a common inlet 46, but open into separate areas 48 and 50 of the housing which serve for receiving a displacement gear wheel or annular displacement gear, respectively. Moreover, an outlet 52 for discharging the conveyed fluid is provided in the housing.

Figure 3:
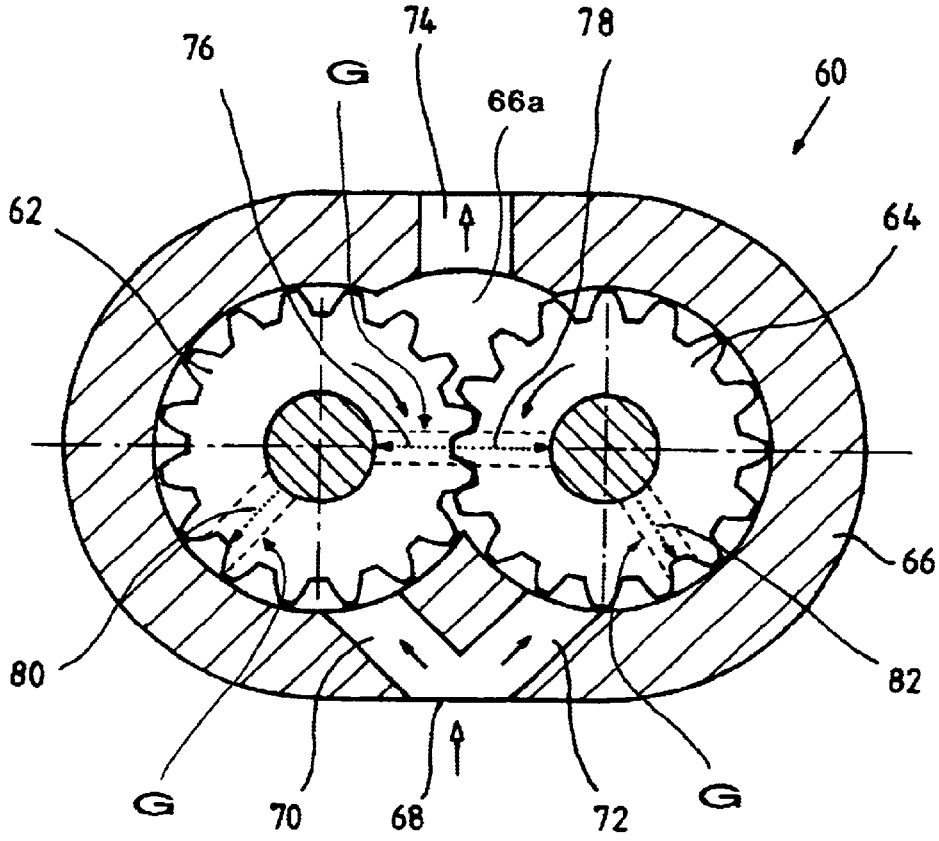
FIG. 3 shows a schematic cross-section of a rotary displacement machine with two meshing displacement gear wheels and with two connecting channels connecting the meshing area with a conveying chamber, respectively.

FIG. 3 shows a schematic cross-section of a rotary displacement machine, referenced in its entirety at 60, with two meshing displacement gear wheels 62 and 64. The displacement gear wheels are arranged in a housing 66 in which two supply channels 70 and 72 are formed which are connected to a common inlet 68; the supply channel 70 opens at the displacement gear wheel 62 and the supply 7 channel 72 opens at the gear wheel 64. Moreover, the housing has an outlet 74.

Figure 4:
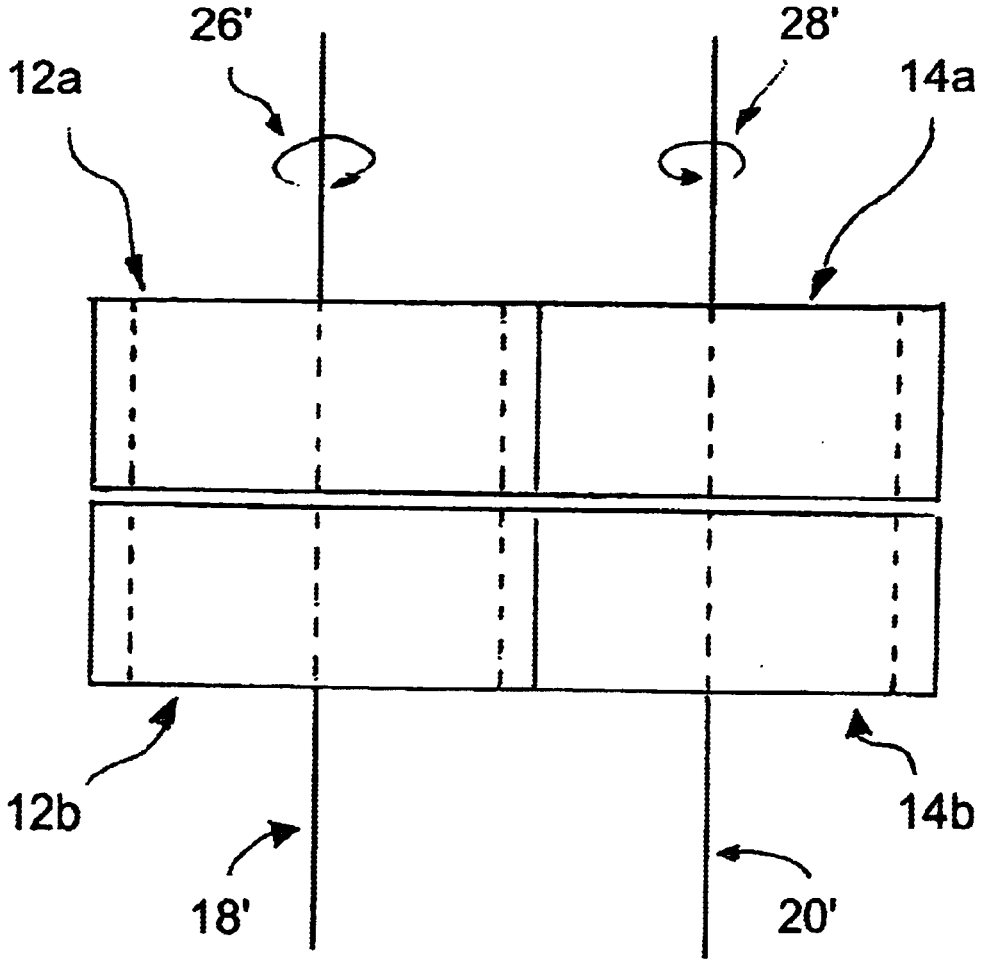
FIG. 4 shows schematically an embodiment with four displacement gear wheels, wherein two gear wheels are arranged on a common axis and rotate in the same direction, respectively.

The special inventive feature of this embodiment is illustrated by the dotted arrows 76, 78, 80, and 82 which illustrate the fluid flow enabled by the connecting channels from the meshing area, in which the displacement gear wheels 62 and 64 mesh with one another, to an area, respectively, across which the conveying chambers formed between the inner wall of the housing and the teeth of each displacement gear wheel pass. The fluid enclosed upon meshing of the displacement gear wheels is thus pressed advantageously into the conveying chambers and increases filling of the chambers and accordingly the conveying efficiency. The connecting channels can be realized in a cost-efficient way, for example, by grooves G, indicated by dashed lines extending parallel to the arrows, on the inner side 66*a* of the housing 66 facing the displacement gear wheels. FIG. 4 shows schematically an embodiment with four displacement gear wheels 12*a*, 12*b*, 14*a*, 14*b* of which two are arranged on a common axis 18' and 20', respectively, and rotate in the same direction (arrows 26', 28'). As mentioned before, it can be sufficient to provide only two supply mouths configured such that the exiting fluid can reach only the displacement gear wheels arranged on the common axis and rotating in the same direction.

We claim:

1. A rotary displacement machine comprising:

a housing;

two or more intermeshing annular displacement gears arranged in the housing and supported rotatably on a stationary axle, respectively;

wherein the annular displacement gears have external teeth for conveying a fluid;

two or more supply channels provided in the housing and having a supply mouth, respectively, opening toward the annular displacement gears for supplying a fluid to the annular displacement gears;

wherein the supply mouth is configured such that, upon operation of the rotary displacement machine, a fluid exiting from the supply mouth reaches either only the teeth of only one of the annular displacement gears or only the teeth of the annular displacement gears arranged on a common one of the stationary axles and rotating in the same direction; and a drive gear wheel meshing in operation of the rotary displacement machine with one of the annular displacement gears, wherein the transmission ratio between drive gear wheel and said one annular displacement gear driven by the drive gear is greater than 1:3.

2. The rotary displacement machine according to claim 1, wherein each one of the supply channels opening in the area of one of the annular displacement gears is embodied such that a flow of fluid, resulting during operation of the rotary displacement machine and flowing through the supply channel in the direction toward said one annular displacement gear, is directed in a transition area between the supply channel and said one annular displacement gear onto flanks of the external teeth of said one annular displacement gear located in the transition area, wherein the flanks face in a direction opposite to the rotational direction of said one annular displacement gear.

3. The rotary displacement machine according to claim 1, wherein the transmission ratio is between 1:4.5 and 1:6.5.

4. The rotary displacement machine according to claim 1, wherein the drive gear wheel is arranged in an area located between the annular displacement gears, wherein the area is sealed against inflowing fluid to be conveyed.

5. The rotary displacement machine according to claim 1, wherein the two annular displacement gears mesh with one another in a meshing area, further comprising at least one connecting channel configured to directly or indirectly connect the meshing area with at least one conveying chamber formed between the external teeth of one of the annular displacement gears and an inner side of the housing.

6. The rotary displacement machine according to claim 5, wherein the connecting channel is formed by a shaping of the housing.

7. The rotary displacement machine according to claim 6, wherein the connecting channel is a groove provided on the inner side of the housing which inner side surrounds the annular displacement gears.

* * * * *